US005894830A

United States Patent [19]

Blass et al.

[11] Patent Number: 5,894,830

[45] Date of Patent: Apr. 20, 1999

[54] ENGINE HAVING A HIGH PRESSURE HYDRAULIC SYSTEM AND LOW PRESSURE LUBRICATING SYSTEM

[75] Inventors: James R. Blass, Bloomington; Dennis H. Gibson, Chillicothe; Dean D. Messinger, Bloomington; Alan R. Stockner, Metamora, all of Ill.

[73] Assignee: Caterpillar Inc., Peoria, Ill.

[21] Appl. No.: 08/990,584

[22] Filed: Dec. 15, 1997

[51] Int. Cl.[6] ..... F02M 55/00; F01M 1/00

[52] U.S. Cl. ..... 123/446; 123/196 R

[58] Field of Search ..... 123/446, 509, 123/196 R, 198 C, 90.12, 90.13; 184/6.28, 6.24; 417/364, 312, 313, 423.3

[56] References Cited

U.S. PATENT DOCUMENTS

| | | | |
|---|---|---|---|
| 4,305,367 | 12/1981 | Imasato et al. | 123/502 |
| 4,373,483 | 2/1983 | Bury | 123/198 C |
| 4,436,067 | 3/1984 | Fritzenwenger | 123/198 C |
| 4,586,468 | 5/1986 | Dzioba | 123/198 C |
| 4,648,363 | 3/1987 | Kronich | 123/196 R |
| 4,653,448 | 3/1987 | Ohmori et al. | 123/446 |
| 4,721,185 | 1/1988 | Weigle | 184/6.12 |
| 4,974,562 | 12/1990 | Ishii et al. | 123/198 C |
| 5,063,895 | 11/1991 | Ampferer | 123/196 R |
| 5,085,768 | 2/1992 | Murakami et al. | 210/222 |
| 5,245,970 | 9/1993 | Iwaszkiewicz | 123/447 |
| 5,271,360 | 12/1993 | Kano et al. | 123/90.31 |
| 5,479,901 | 1/1996 | Gibson et al. | 123/472 |
| 5,515,829 | 5/1996 | Wear et al. | 123/446 |
| 5,606,943 | 3/1997 | Tamba et al. | 123/90.23 |
| 5,725,361 | 3/1998 | Danlgraber | 417/312 |
| 5,769,182 | 6/1998 | Parenteau | 184/6.24 |
| 5,816,212 | 10/1998 | Lindquist et al. | 123/196 R |

*Primary Examiner*—Thomas N. Moulis
*Attorney, Agent, or Firm*—Michael McNeil

[57] ABSTRACT

An engine includes an engine housing having an oil pan with an amount of oil therein. An oil lubricating system for the engine has a low pressure pump attached to the engine housing. A hydraulic system, which uses the same oil as the lubricating system, has a high pressure pump positioned in the oil pan, attached to the engine housing, and at least partially submerged in the oil.

20 Claims, 1 Drawing Sheet

ENGINE HAVING A HIGH PRESSURE HYDRAULIC SYSTEM AND LOW PRESSURE LUBRICATING SYSTEM

TECHNICAL FIELD

The present invention relates generally to engines that utilize hydraulic devices, and more particularly to an engine that utilizes a low pressure pump to circulate lubricating oil through the engine and a high pressure pump to pressurize the same oil to actuate hydraulic devices.

BACKGROUND ART

Engines have long utilized a variety of devices that draw power directly or indirectly from the engine for their operation. Among these devices are fuel injectors, gas intake and exhaust valves, exhaust brakes, etc. In the past, these devices were typically actuated by a cam that is driven directly by the engine. In order to improve engine performance across its operating spectrum, there has been a trend in the industry toward the adoption of electronically controlled hydraulic devices. An example of this trend is the hydraulically-actuated electronically-controlled unit injector (HEUI) system utilized by Caterpillar Inc. of Peoria, Ill. in their diesel engines.

In a typical HEUI system, a high pressure pump maintains a manifold at a relatively high pressure that is sufficient to actuate the hydraulic fuel injectors. The high pressure pump draws oil from a reservoir that is filled by the engine's low pressure oil circulation pump. After the high pressure oil is utilized by the fuel injectors, it is circulated back to the oil pan. Thus, a portion of the oil moved by the low pressure oil lubrication pump is circulated through the engine for lubrication, and another portion is pumped into the reservoir that supplies the high pressure pump.

In this current system, the high pressure pump is attached to the outside the engine, and thus any noise emitted from the pump is easily detectable. In addition, the reservoir that supplies the high pressure pump is above the engine's oil pan. This can result in excessive engine cranking from a cold start while the low pressure pump provides enough oil to the reservoir for the high pressure hydraulic system to achieve the relatively high pressures necessary for its operation. Not only does the high pressure pump tend to emit noise, but its location on the outside of the engine creates a protrusion that undermines the ability to position the engine in a confined space.

The present invention is directed to overcoming the engine packaging, noise reduction and other undesirable attributes associated with prior art engines that utilize hydraulic devices.

DISCLOSURE OF THE INVENTION

In one embodiment, an engine includes an engine housing. An oil lubricating system has a low pressure pump attached to the engine housing. A hydraulic system has a high pressure pump attached to the engine housing and is at least partially submerged in an amount of oil. In one aspect, the high pressure pump is positioned below the level of the oil in the engine's oil pan. In still another aspect, the high pressure pump is at least partially submerged in the oil within the oil pan.

BEST MODE FOR CARRYING OUT THE INVENTION

Figure 1:
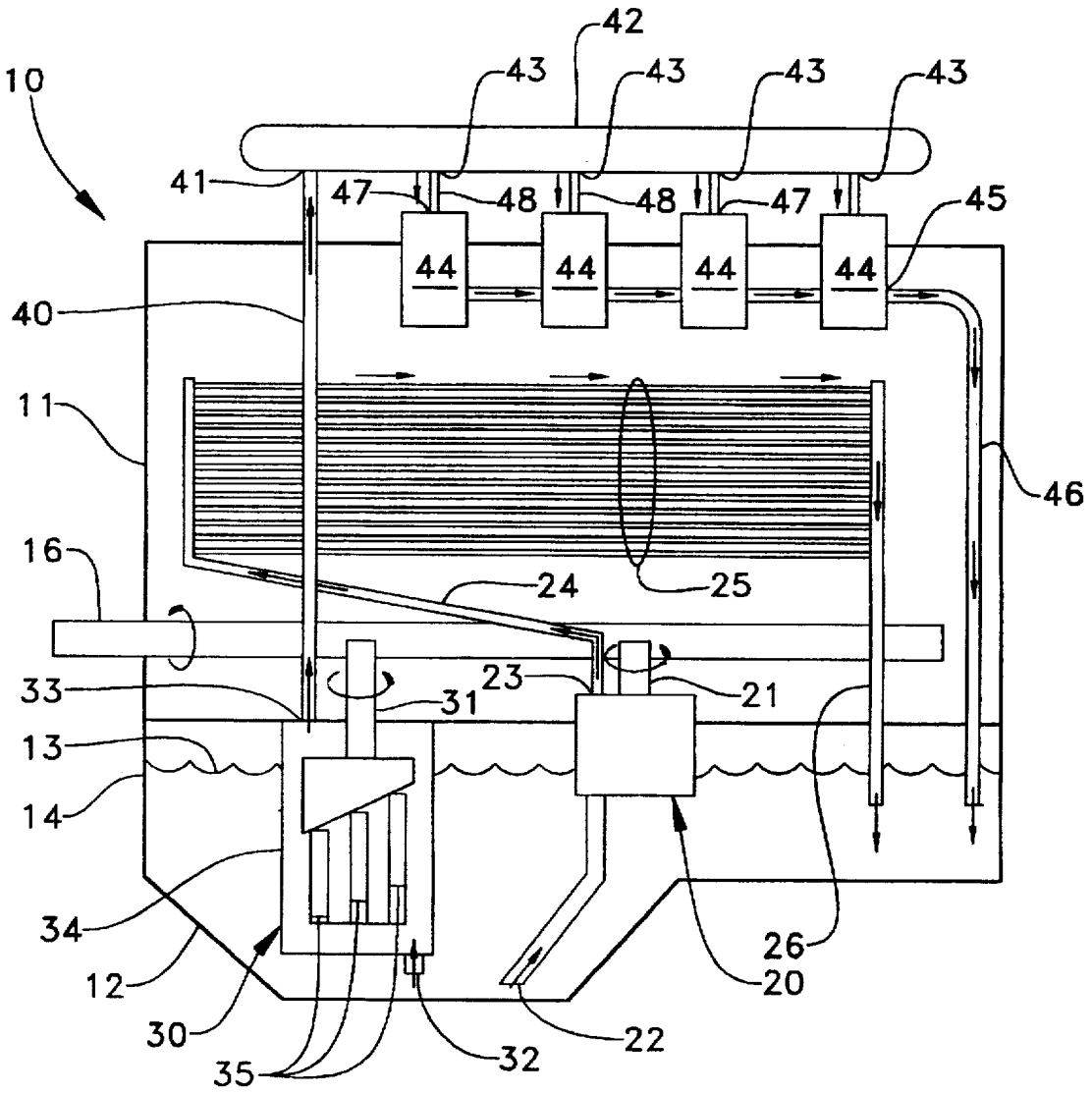
FIG. 1 is a schematic illustration of an engine according to a preferred embodiment of the present invention.

Referring now to FIG. 1, an engine 10 includes an engine casing 11. An oil pan 12, which is a portion of engine casing 11, is filled with an amount of lubricating oil 13 up to a level 14. Engine 10 includes a conventional lubricating system that includes a low pressure pump 20 that is powered via a pump shaft 21 coupled in a known manner to the drive shaft 16 of the engine. Low pressure pump 20 includes an inlet 22 that opens into the oil 13 in oil pan 12, and an outlet 23 that opens into circulation conduit 24 in a conventional manner. After leaving circulation conduit 24, the lubricating oil passes through a plurality of lubrication passages 25 that maintain the various moving parts within engine 10 properly lubricated. The oil then reconverges in a return conduit 26 and is circulated back to oil pan 12 in a conventional manner.

Operating in parallel to the engine's lubricating system is a hydraulic system that utilizes the lubricating oil 13 as a hydraulic medium in actuating a plurality of hydraulic devices 44. The hydraulic system includes a high pressure pump 30 that is positioned in oil pan 12 and partially submerged in oil 13 such that at least a portion of the pump housing 34 is positioned below oil level 14. Pump 30 is preferably a swash plate type pump having a plurality of parallel oriented pistons 35 that reciprocate as pump shaft 31 rotates. Pump shaft 31 is coupled to rotate with drive shaft 16 of engine 10 in a conventional manner. Inlet 32 of pump 30 is positioned near the bottom of oil pan 12 in order to always be exposed to a ready supply of oil 13. Pressurized oil leaves pump 30 at outlet 33 and travels along high pressure supply pipe 40 to the inlet 41 of a high pressure manifold 42.

High pressure manifold 42 has a plurality of outlets 43, each of which is connected to a respective branch passage 48. The inlets 47 of a plurality of hydraulic devices 44 are each connected to a separate branch passage 48. For purposes of the present invention, the hydraulic devices 44 can include as examples hydraulically-actuated fuel injectors, exhaust brakes, intake or exhaust gas exchange valves, or any other suitable hydraulic device utilized by the engine during its operation. The drain ports 45 of the hydraulic devices empty into a common return pipe 46 that returns the oil to oil pan 12 for recirculation.

Industrial Applicability

The present invention achieves its goal of noise reduction by submerging the high pressure pump in an amount of oil that damps the noise produced during the normal operation of the pump. Additional noise attenuation is achieved by the enclosure of the high pressure pump in the oil pan. In prior art hydraulic systems, the high pressure pump was typically attached on the outside of the engine, and thus it radiated undesirable noise away from the engine. Those skilled in the art will appreciate that this noise reduction feature of the present invention could also be achieved by submerging the high pressure pump in oil at a location other than in the oil pan portion of the engine.

By positioning the inlet of the high pressure pump near the bottom of the oil pan, the hydraulic system is always exposed to a ready supply of oil, especially when the engine is undergoing a cold start condition. In the past, the inlet of the high pressure pump was exposed to a secondary reservoir located at a position well above the oil pan and supplied by the same low pressure pump that circulates the lubricating oil through the engine. As a consequence, the engine could sometimes be required to crank excessively before the engine could start since the secondary reservoir would have to be substantially filled before the hydraulic system could have sufficient amounts of oil to draw upon for the necessary operation of the hydraulic devices. The present invention overcomes this perceived irritation by always exposing the inlet of the high pressure pump to oil in the oil pan. Those skilled in the art will appreciate that this aspect of the present invention can be accomplished in other ways, including exposing the inlet of the high pressure pump to an oil compartment other than the oil pan that is positioned below the natural level 14 of the oil in the oil pan.

The present invention also aids in streamlining engine packaging since a separate oil reservoir for the high pressure pump is no longer needed and the pump is now positioned within the engine casing as opposed to being attached to the outside surface of the engine as in the prior art. Thus, the engines incorporating the present invention should not only perform better than their prior art counterparts, but should also have the ability to occupy less space than their prior art counterparts. This permits engines according to the present invention to be positioned in confined spaces that might not otherwise be possible in prior art engines.

The above description is intended for illustrative purposes only, and is not intended to limit the scope of the present invention in any way. For instance, while the low and high pressure oil circulation systems in the illustrated embodiment are shown to be completely parallel, those skilled in the art will appreciate that other variations might be possible. For instance, the excess pressure leaving the hydraulic devices could be harnessed to push oil through the lubricating passages of the engine before being returned to the oil pan. Thus, various modifications could be made to the illustrated embodiment without departing from the spirit and scope of the present invention, which is defined in terms of the claims as set forth below.

We claim:

1. An engine comprising:

an engine housing having an oil pan with an amount of oil therein;

an oil lubricating system having a low pressure pump attached to said engine housing;

a hydraulic system having a high pressure pump attached to said engine housing and being at least partially submerged in said amount of oil.

2. The engine of claim 1 wherein said hydraulic system includes a high pressure manifold and a plurality of hydraulic devices attached to said engine housing;

an inlet to said high pressure manifold being connected to an outlet from said high pressure pump; and an outlet from said high pressure manifold being connected to an inlet of each of said plurality of hydraulic devices.

3. The engine of claim 2 wherein a portion of said plurality of hydraulic devices are fuel injectors.

4. The engine of claim 2 wherein a portion of said plurality of hydraulic devices are actuators for gas exchange valves or exhaust brakes.

5. The engine of claim 1 further comprising an engine drive shaft at least partially positioned in said engine housing;

said high pressure pump has a rotating shaft coupled to, and rotatable with, said engine drive shaft; and said high pressure pump has a plurality of reciprocating pistons operably coupled to said rotating shaft.

6. The engine of claim 1 wherein said high pressure pump has an inlet that opens directly into said amount of oil.

7. An engine comprising:

an engine housing having an oil pan with oil therein up to a level;

an oil lubricating system having a low pressure pump attached to said engine housing;

a hydraulic system having a high pressure pump attached to said engine housing and being at least partially positioned below said level.

8. The engine of claim 7 wherein said high pressure pump is at least partially submerged in an amount of oil.

9. The engine of claim 8 wherein a portion of said high pressure pump is positioned in said oil pan.

10. The engine of claim 9 wherein said high pressure pump has an inlet that opens directly into said oil in said oil pan.

11. The engine of claim 10 further comprising an engine drive shaft at least partially positioned in said engine housing;

said high pressure pump has a rotating shaft coupled to, and rotatable with, said engine drive shaft; and said high pressure pump has a plurality of reciprocating pistons operably coupled to said rotating shaft.

12. The engine of claim 11 wherein said hydraulic system includes a high pressure manifold and a plurality of hydraulic devices attached to said engine housing;

an inlet to said high pressure manifold being connected to an outlet from said high pressure pump; and an outlet from said high pressure manifold being connected to an inlet of each of said plurality of hydraulic devices.

13. The engine of claim 12 wherein a portion of said plurality of hydraulic devices are fuel injectors.

14. The engine of claim 12 wherein a portion of said plurality of hydraulic devices are actuators for gas exchange valves or exhaust brakes.

15. An engine comprising:

an engine housing;

an oil lubricating system having a low pressure pump attached to said engine housing;

a hydraulic system having a high pressure pump attached to said engine housing and being at least partially submerged in an amount of oil.

16. The engine of claim 15 wherein said hydraulic system includes a high pressure manifold and a plurality of hydraulic devices attached to said engine housing;

an inlet to said high pressure manifold being connected to an outlet from said high pressure pump; and an outlet from said high pressure manifold being connected to an inlet of each of said plurality of hydraulic devices.

17. The engine of claim 16 wherein said engine housing includes an oil pan having oil therein up to a level; and a portion of said high pressure pump is positioned below said level.

18. The engine of claim 16 wherein a portion of said high pressure pump is positioned in said oil pan.

19. The engine of claim 18 wherein said high pressure pump has an inlet that opens directly into said oil in said oil pan.

20. The engine of claim 19 further comprising an engine drive shaft at least partially positioned in said engine housing;

said high pressure pump has a rotating shaft coupled to, and rotatable with, said engine drive shaft; and said high pressure pump has a plurality of reciprocating pistons operably coupled to said rotating shaft.

* * * * *